US007931051B2

(12) United States Patent
Ward et al.

(10) Patent No.: US 7,931,051 B2
(45) Date of Patent: Apr. 26, 2011

(54) MULTI-LAYER PAPERMAKER'S FORMING FABRIC WITH LONG MACHINE SIDE MD FLOATS

(75) Inventors: Kevin John Ward, Coldbrook (CA); Jason Goins, Graham, NC (US)

(73) Assignee: Weavexx Corporation, Wake Forest, NC (US)

( * ) Notice: Subject to any disclaimer, the term of this patent is extended or adjusted under 35 U.S.C. 154(b) by 0 days.

(21) Appl. No.: 12/708,684

(22) Filed: Feb. 19, 2010

(65) Prior Publication Data

US 2010/0147410 A1 Jun. 17, 2010

Related U.S. Application Data

(62) Division of application No. 12/018,385, filed on Jan. 23, 2008, now abandoned.

(51) Int. Cl.

| | |
|---|---|
| ***D21F 7/08*** | (2006.01) |
| ***D03D 3/04*** | (2006.01) |
| *D03D 25/00* | (2006.01) |

(52) U.S. Cl. ..... 139/383 A; 139/383 R; 139/383 AA; 162/358.2

(58) Field of Classification Search ..... 139/383 A, 139/383 AA; 162/358.2; 442/203, 205
See application file for complete search history.

(56) References Cited

U.S. PATENT DOCUMENTS

| | | | |
|---|---|---|---|
| 2,172,430 | A | 9/1939 | Barrell |
| 2,554,034 | A | 5/1951 | Koester et al. |
| 3,094,149 | A | 6/1963 | Keily |
| 3,325,909 | A | 6/1967 | Clark |
| 4,093,512 | A | 6/1978 | Fleischer |
| 4,182,381 | A | 1/1980 | Gisbourne |
| 4,244,543 | A | 1/1981 | Ericson |
| 4,289,173 | A | 9/1981 | Miller |
| 4,290,209 | A | 9/1981 | Buchanan et al. |
| 4,414,263 | A | 11/1983 | Miller et al. |
| 4,438,788 | A | 3/1984 | Harwood |
| 4,452,284 | A | 6/1984 | Eckstein et al. |
| 4,453,573 | A | 6/1984 | Thompson |
| 4,501,303 | A | 2/1985 | Osterberg |

(Continued)

FOREIGN PATENT DOCUMENTS

| | | |
|---|---|---|
| DE | 454 092 | 12/1927 |

(Continued)

OTHER PUBLICATIONS

International Search Report for PCT/US2004/008311.
International Search Report for PCT Application No. PCT/US97/18629.

(Continued)

*Primary Examiner* — Bobby H Muromoto, Jr.
(74) *Attorney, Agent, or Firm* — Myers Bigel Sibley & Sajovec

(57) ABSTRACT

A papermaker's fabric includes: a set of top MD yarns; a set of bottom MD yarns; a set of top CMD yarns interwoven with the top MD yarns to form a top fabric layer; a set of bottom CMD yarns interwoven with the bottom MD yarns to form a bottom fabric layer; and a set of stitching yarns that interweave with the top and bottom fabric layers. The top MD yarns and the top CMD yarns are interwoven in a series of repeat units and the bottom MD yarns and the bottom CMD yarns are interwoven in a series of corresponding repeat units. Each of the bottom MD yarns forms a bottom MD float by passing under three or more consecutive bottom CMD yarns.

12 Claims, 9 Drawing Sheets

U.S. PATENT DOCUMENTS 4,515,853 A * 5/1985 Borel ..... 442/205
4,529,013 A 7/1985 Miller
4,564,052 A * 1/1986 Borel ..... 139/425 A
4,564,551 A 1/1986 Best
4,592,395 A * 6/1986 Borel ..... 139/383 A
4,592,396 A 6/1986 Borel et al.
4,605,585 A 8/1986 Johansson
4,611,639 A 9/1986 Bugge
4,621,663 A 11/1986 Malmendier
4,633,596 A 1/1987 Josef
4,636,426 A 1/1987 Fleischer
4,642,261 A 2/1987 Fearnhead
4,676,278 A 6/1987 Dutt
4,705,601 A 11/1987 Chiu
4,709,732 A 12/1987 Kinnunen
4,729,412 A 3/1988 Bugge
4,731,281 A 3/1988 Fleischer et al.
4,739,803 A * 4/1988 Borel ..... 139/383 A
4,755,420 A 7/1988 Baker et al.
4,759,975 A 7/1988 Sutherland et al.
4,784,190 A * 11/1988 Mullaney ..... 139/383 A
4,815,499 A 3/1989 Johnson
4,815,503 A * 3/1989 Borel ..... 139/383 A
4,909,284 A 3/1990 Kositzke
RE33,195 E 4/1990 McDonald et al.
4,928,737 A * 5/1990 Borel ..... 139/383 A
4,934,414 A 6/1990 Borel
4,941,514 A 7/1990 Taipale
4,942,077 A 7/1990 Wendt et al.
4,945,952 A 8/1990 Vöhringer
4,967,805 A 11/1990 Chiu et al.
4,982,766 A * 1/1991 Taipale et al. ..... 139/383 A
4,987,929 A 1/1991 Wilson
4,989,647 A 2/1991 Marchand
4,989,648 A 2/1991 Tate et al.
4,998,568 A 3/1991 Vohringer
4,998,569 A 3/1991 Tate
5,022,441 A 6/1991 Tate et al.
5,025,839 A 6/1991 Wright
5,067,526 A 11/1991 Herring
5,074,339 A 12/1991 Vohringer
5,084,326 A 1/1992 Vohringer
5,089,324 A * 2/1992 Jackson ..... 442/195
5,092,372 A 3/1992 Fitzka et al.
5,094,719 A * 3/1992 Fry ..... 162/358.2
5,101,866 A 4/1992 Quigley
5,110,672 A * 5/1992 Zehle et al. ..... 442/240
5,116,478 A 5/1992 Tate et al.
5,135,802 A * 8/1992 Gstrein et al. ..... 442/206
5,152,326 A 10/1992 Vohringer
5,158,118 A 10/1992 Tate et al.
5,219,004 A 6/1993 Chiu
5,228,482 A 7/1993 Fleischer
5,277,967 A * 1/1994 Zehle et al. ..... 442/206
5,343,896 A * 9/1994 Schroder et al. ..... 139/383 A
5,358,014 A 10/1994 Kovar
5,421,374 A 6/1995 Wright
5,421,375 A 6/1995 Praetzel
5,429,686 A 7/1995 Chiu et al.
5,437,315 A 8/1995 Ward
5,449,026 A 9/1995 Lee
5,454,405 A 10/1995 Hawes
5,456,293 A 10/1995 Ostermayer et al.
5,465,764 A 11/1995 Eschmann et al.
5,482,567 A 1/1996 Barreto
5,487,414 A 1/1996 Kuji et al.
5,503,196 A 4/1996 Josef et al.
5,518,042 A 5/1996 Wilson
5,520,225 A 5/1996 Quigley et al.
5,542,455 A 8/1996 Ostermayer et al.
5,549,967 A * 8/1996 Gstrein ..... 442/200
5,555,917 A 9/1996 Quigley
5,564,475 A 10/1996 Wright
5,618,612 A * 4/1997 Gstrein ..... 442/189
5,641,001 A 6/1997 Wilson
5,651,394 A 7/1997 Marchand
5,709,250 A 1/1998 Ward et al.
RE35,777 E 4/1998 Givin
5,746,257 A 5/1998 Fry
5,806,569 A * 9/1998 Gulya et al. ..... 139/383 A
5,826,627 A 10/1998 Seabrook et al.
5,853,547 A * 12/1998 Ahrens et al. ..... 162/348
5,857,498 A 1/1999 Barreto et al.
5,881,764 A 3/1999 Ward
5,891,516 A * 4/1999 Gstrein et al. ..... 427/189
5,894,867 A 4/1999 Ward et al.
5,899,240 A 5/1999 Wilson
5,937,914 A 8/1999 Wilson
5,967,195 A 10/1999 Ward
5,975,149 A * 11/1999 Lee et al. ..... 139/383 A
5,983,953 A 11/1999 Wilson
6,000,440 A * 12/1999 Hay ..... 139/383 A
6,073,661 A 6/2000 Wilson
6,110,324 A * 8/2000 Trokhan et al. ..... 162/358.2
6,112,774 A 9/2000 Wilson
6,123,116 A 9/2000 Ward et al.
6,145,550 A 11/2000 Ward
6,148,869 A 11/2000 Quigley
6,158,478 A 12/2000 Lee et al.
6,175,996 B1 * 1/2001 Gstrein et al. ..... 28/114
6,179,965 B1 1/2001 Cunnane et al.
6,202,705 B1 3/2001 Johnson et al.
6,207,598 B1 3/2001 Lee et al.
6,227,255 B1 5/2001 Osterberg et al.
6,237,644 B1 5/2001 Hay et al.
6,240,973 B1 6/2001 Stone et al.
6,244,306 B1 6/2001 Troughton
6,253,796 B1 7/2001 Wilson et al.
6,276,402 B1 8/2001 Herring
6,379,506 B1 4/2002 Wilson et al.
6,383,339 B1 * 5/2002 Gstrein ..... 162/358.4
6,581,645 B1 6/2003 Johnson et al.
6,585,006 B1 7/2003 Wilson et al.
6,616,812 B2 * 9/2003 Beck ..... 162/358.2
6,699,367 B2 * 3/2004 Gstrein et al. ..... 162/358.2
6,708,732 B1 * 3/2004 Hay et al. ..... 139/383 A
6,763,855 B2 * 7/2004 Rougvie ..... 139/383 A
6,810,917 B2 * 11/2004 Stone ..... 139/383 A
6,837,276 B2 * 1/2005 Josef et al. ..... 139/383 A
6,837,277 B2 1/2005 Troughton et al.
6,899,143 B2 5/2005 Rougvie et al.
7,001,489 B2 2/2006 Taipale et al.
7,059,357 B2 6/2006 Ward
7,059,361 B1 * 6/2006 Hansson ..... 139/383 A
7,108,020 B2 9/2006 Stone
2003/0010393 A1 1/2003 Kuji
2004/0079434 A1 4/2004 Martin et al.
2004/0102118 A1 5/2004 Hay et al.
2005/0268981 A1 12/2005 Barratte

FOREIGN PATENT DOCUMENTS

DE 3318960 A1 11/1984
DE 33 29 740 A1 3/1985
DE 10 2005 041 042 A1 3/2007
EP 0 048 962 B2 9/1981
EP 0 158 710 A1 10/1984
EP 0 185 177 B1 10/1985
EP 0 224 276 B1 12/1986
EP 0 264 881 B1 10/1987
EP 0 269 070 B1 11/1987
EP 0 284 575 B1 2/1988
EP 0 283 181 B1 3/1988
EP 0 350 673 B1 6/1989
EP 0 408 849 A2 5/1990
EP 0 408 849 A3 5/1990
EP 0 672 752 B1 3/1995
EP 0 794 283 A1 9/1997
EP 1 630 283 A1 3/2006
FR 2 597 123 4/1986
GB 2157328 A 10/1985
GB 2245006 A 2/1991
JP 8-158285 12/1994
WO WO 86/00099 A1 1/1986
WO WO 89/09848 A1 4/1989
WO WO 03/010304 A2 11/1992
WO WO 99/61698 A1 12/1999
WO WO 02/00096 A2 1/2002

| | | | |
|---|---|---|---|
| WO | WO 03/093573 | A1 | 11/2003 |
| WO | WO 2005/017254 | A1 | 2/2005 |
| WO | WO 2006/015377 | A2 | 2/2006 |

OTHER PUBLICATIONS

Rule 132 Declaration of Robert G. Wilson (Jun. 26, 1997).

Warren, C.A., "The Importance of Yarn Properties in Wet-End Wire Construction," Seminar, The Theory of Water Removal, Dec. 12, 1979.

European Search Report corresponding to application No. EP 05002306.8, dated Oct. 18, 2005.

International Search Report and Written Opinion of the International Searching Authority of International Application No. PCT/US2007/022434 (12 pages) (Feb. 8, 2008).

Partial International Search for PCT/US2009/000093 mailed May 15, 2009.

* cited by examiner

MULTI-LAYER PAPERMAKER'S FORMING FABRIC WITH LONG MACHINE SIDE MD FLOATS

RELATED APPLICATIONS

This application is a divisional application of application Ser. No. 12/018,385, filed Jan. 23, 2008 now abandoned, the contents of which are hereby incorporated by reference as if recited in full herein.

FIELD OF THE INVENTION

This application is directed generally to papermaking, and more specifically to fabrics employed in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run that operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is enhanced by the presence of a "batt" layer of the press felt. The paper is then transferred to a dryer section for further moisture removal. After drying, the paper is ready for secondary processing and packaging.

As used herein, the terms machine direction ("MD") and cross machine direction ("CMD") refer, respectively, to a direction aligned with the direction of travel of the papermakers' fabric on the papermaking machine, and a direction parallel to the fabric surface and traverse to the direction of travel. Likewise, directional references to the vertical relationship of the yarns in the fabric (e.g., above, below, top, bottom, beneath, etc.) assume that the papermaking surface of the fabric is the top of the fabric and the machine side surface of the fabric is the bottom of the fabric.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are now commercially available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure. Typically, finely woven fabrics such as those used in fine paper and tissue applications include at least some relatively small diameter machine direction or cross machine direction yarns. Regrettably, however, such yarns tend to be delicate, leading to a short surface life for the fabric. Moreover, the use of smaller yarns can also adversely affect the mechanical stability of the fabric (especially in terms of skew resistance, narrowing propensity and stiffness), which may negatively impact both the service life and the performance of the fabric.

To combat these problems associated with fine weave fabrics, multi-layer forming fabrics have been developed with fine-mesh yarns on the paper forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paperside fabric layer and a separate, coarser machine side fabric layer. In these fabrics, which are part of a class of fabrics generally referred to as "triple layer" fabrics, the two fabric layers are typically bound together by separate stitching yarns. However, they may also be bound together using yarns from one or more of the sets of bottom and top cross machine direction and machine direction yarns. As double and triple layer fabrics include additional sets of yarn as compared to single layer fabrics, these fabrics typically have a higher "caliper" (i.e., they are thicker) than comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, U.S. Pat. Nos. 5,437,315 and 5,967,195 to Ward, and U.S. Pat. No. 6,745,797 to Troughton.

U.S. Pat. No. 5,967,195 to Ward discloses a triple layer fabric in which pairs of stitching yarns extend in the cross machine direction and form part of the papermaking surface, in essence "completing the weave" of the papermaking surface, while also stitching with the bottom layer. The fabrics disclosed in Ward have the same number of top machine direction yarns and bottom machine direction yarns. Such fabrics have proven to provide an excellent papermaking surface (particularly due to the integration of the stitching yarns into the weave of the papermaking surface) and to combat inter-layer wear. U.S. Pat. No. 6,896,009 shows a similar concept with MD stitching yarns. However, in some applications (e.g., brown paper), high open area and fiber support may be desirable. Also, the improvement of other performance characteristics, such as wear resistance, may be desirable.

SUMMARY OF THE INVENTION

As a first aspect, embodiments of the present invention are directed to a papermaker's fabric, comprising: a set of top MD yarns; a set of bottom MD yarns; a set of top CMD yarns interwoven with the top MD yarns to form a top fabric layer; a set of bottom CMD yarns interwoven with the bottom MD yarns to form a bottom fabric layer; and a set of stitching yarns that interweave with the top and bottom fabric layers. The top MD yarns and the top CMD yarns are interwoven in a series of repeat units and the bottom MD yarns and the bottom CMD yarns are interwoven in a series of corresponding repeat units. Each of the bottom MD yarns forms a bottom MD float by passing under three or more consecutive bottom CMD yarns.

As a second aspect, embodiments of the present invention are directed to a papermaker's fabric, comprising: a set of top MD yarns; a set of bottom MD yarns; a set of CMD yarns interwoven with the top MD yarns to form a top fabric layer; and a set of CMD stitching yarn pairs that interweave with the top and bottom fabric layers. The top MD yarns and the top CMD yarns are interwoven in a series of repeat units and the bottom MD yarns and the bottom CMD yarns are interwoven in a series of corresponding repeat units. Each of the bottom MD yarns forms a bottom MD float by passing under three or more consecutive CMD stitching yarn pairs.

As a third aspect, embodiments of the present invention are directed to a papermaker's fabric, comprising: a set of MD stitching yarns, the stitching yarns being arranged in pairs; a set of bottom MD yarns; a set of top CMD yarns interwoven with the MD stitching yarns to form a top fabric layer; and a set of bottom CMD yarns interwoven with the bottom MD yarns to form a bottom fabric layer. The MD stitching yarns and the top CMD yarns are interwoven in a series of repeat units and the bottom MD yarns, the MD stitching yarns and the bottom CMD yarns are interwoven in a series of corresponding repeat units. The MD stitching yarns have a first diameter, the bottom MD yarns have a second diameter, and the first diameter is less than the second diameter.

DETAILED DESCRIPTION OF EMBODIMENTS OF THE INVENTION

Figure 1:
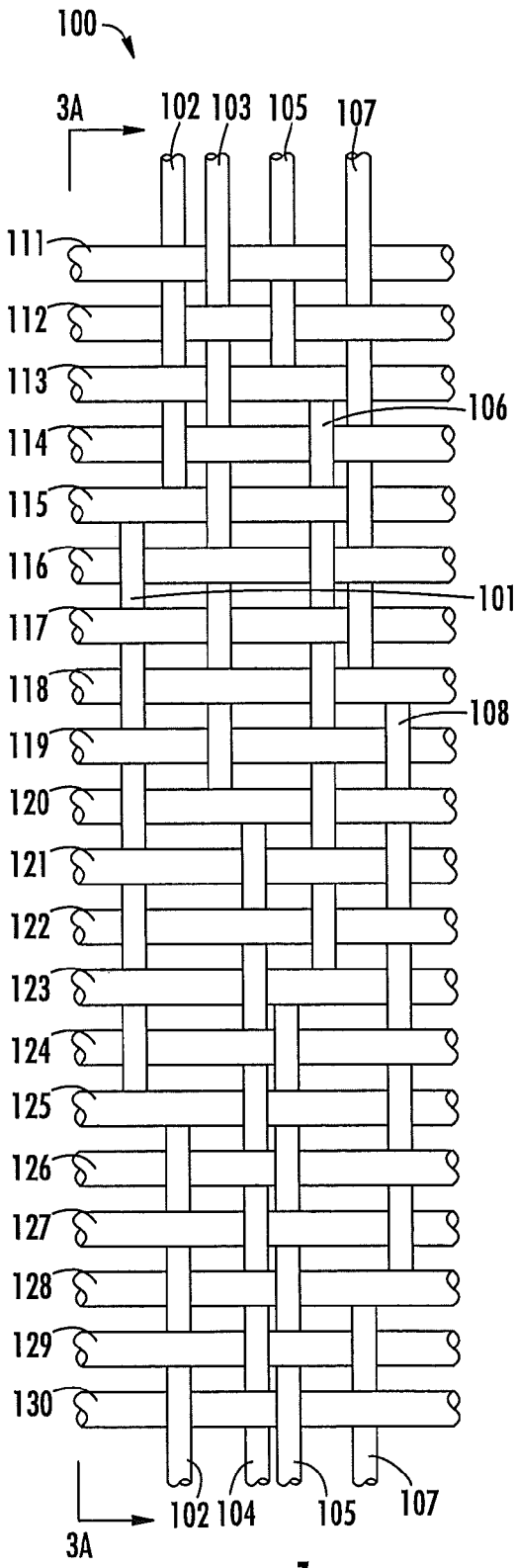
FIG. 1 is a top view of the top layer of a repeat unit of a fabric according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Although the figures below only show single repeat units of the fabrics illustrated therein, those of skill in the art will appreciate that in commercial applications the repeat units shown in the figures would be repeated many times, in both the machine and cross machine directions, to form a large fabric suitable for use on a papermaking machine.

Turning now to FIGS. 1-3B, a repeat unit of a forming fabric according to embodiments of the present invention, designated broadly at 100, is illustrated therein. The repeat unit 100 includes eight MD stitching yarns 101-108, twenty top CMD yarns 111-130, four bottom MD yarns 141-144, and eight bottom CMD yarns 151-158. The interweaving of these yarns is described below.

Figure 3A:
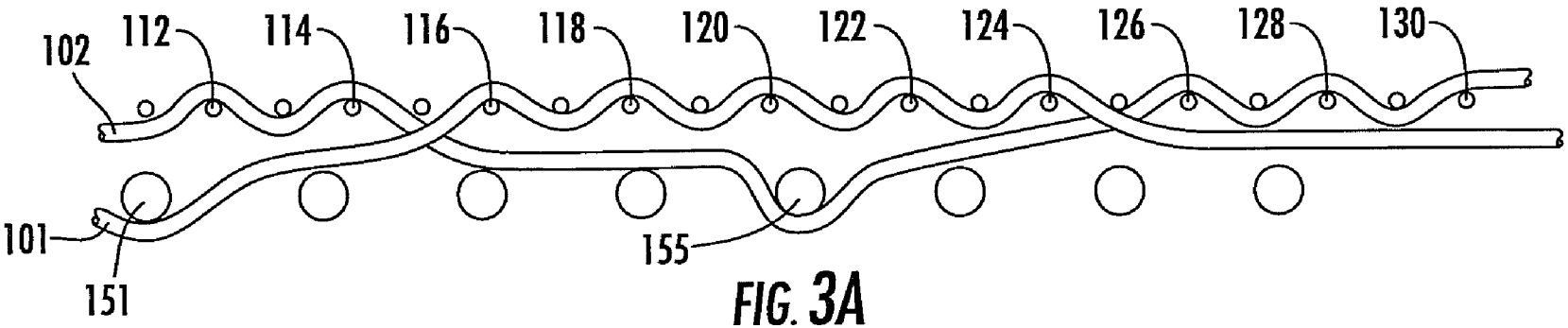
FIGS. 3A and 3B are section views taken along lines 3A-3A and 3B-3B, respectively, of the fabric of FIGS. 1A and 1B showing typical MD yarns.

As can be seen in FIGS. 1 and 3A, the MD stitching yarns 101-108 are disposed in pairs, wherein each pair together interweaves with the top CMD yarns 111-130 in an "over 1/under 1" sequence. For example, as can be seen in FIGS. 1 and 3A, MD stitching yarn 101 follows an "over 1/under 1" pattern relative to the top CMD yarns to form five consecutive MD knuckles (passing over even-numbered top CMD yarns 116, 118, 120, 122, 124 and below odd-numbered top CMD yarns 117, 119, 121, 123). MD stitching yarn 101 passes below the remaining top CMD yarns. Paired stitching yarn 102 follows an "over 1/under 1" pattern relative to the top CMD yarns to form five consecutive MD knuckles (passing over even-numbered top CMD yarns 126, 128, 130, 112, 114 and below top odd-numbered CMD yarns 127, 129, 101, 103). MD stitching yarn 102 passes below the remaining top CMD yarns. Thus, together the stitching yarns 101, 102 pass above all of the even-numbered top CMD yarns and below the odd-numbered top CMD yarns. The remaining MD stitching yarn pairs (i.e., MD stitching yarns 103, 104, MD stitching yarns 105, 106, and MD stitching yarns 107, 108) follow a similar "over 1/under 1" sequence with the top CMD yarns, with the result that the MD stitching yarns and the top CMD yarns form a plain weave top, or papermaking, surface.

Figure 2:
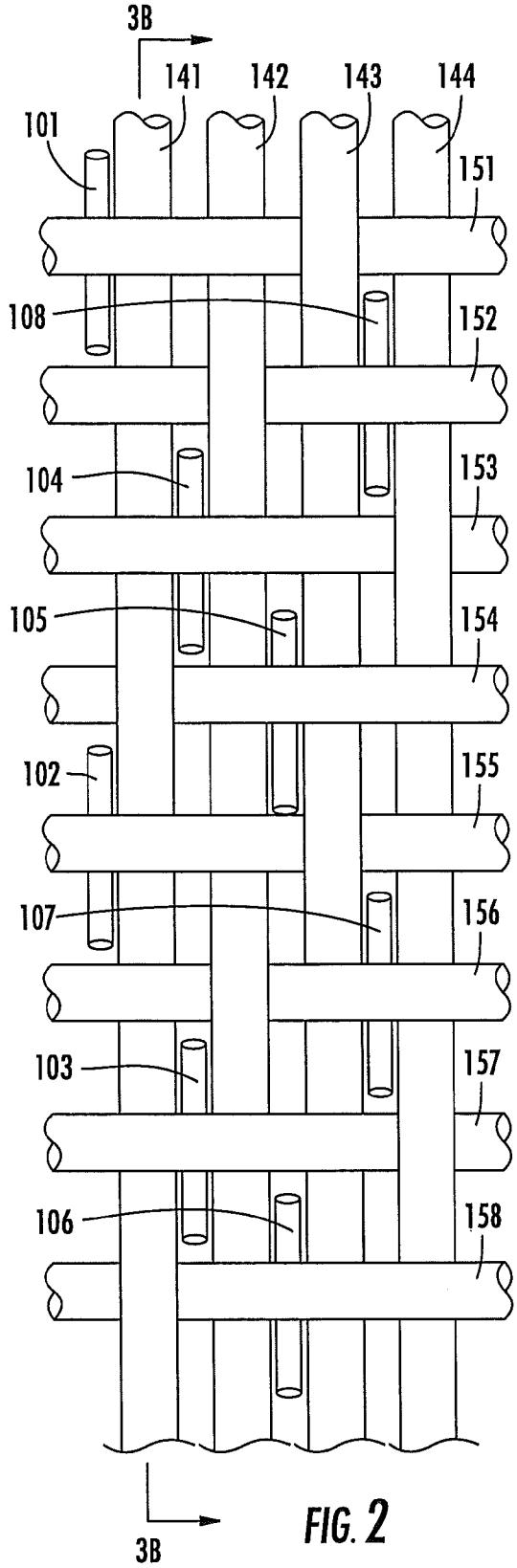
FIG. 2 is a top view of the bottom layer of the fabric of FIG. 1.

Turning now to FIG. 2 and also to FIG. 3A, the MD stitching yarns 101-108 also interweave with the bottom CMD yarns 151-158. Each of the MD stitching yarns 101-108 passes below one bottom CMD yarn, with the MD stitching yarns of each pair together forming "over 3/under 1" pattern. For example, and referring to FIG. 3B, MD stitching yarn 101 passes under bottom CMD yarn 151 and over the remaining bottom CMD yarns. MD stitching yarn 102 passes under bottom CMD yarn 155, thus forming the "over 3/under 1" sequence with the bottom CMD yarns noted above. The remaining MD stitching yarn pairs similarly form an "over 3/under 1" sequence with the bottom CMD yarns. Each pair of stitching yarns weaves between two adjacent bottom MD yarns.

Figure 3B:
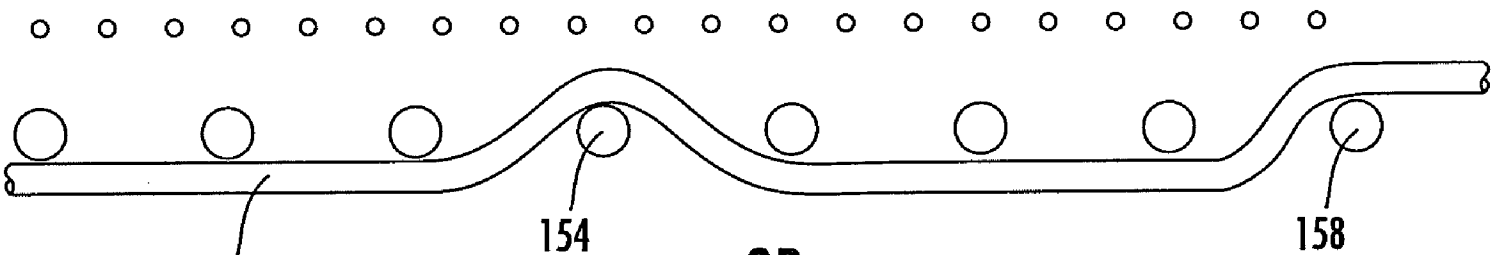

Referring again to FIG. 2 and also to FIG. 3B, the bottom MD yarns 141-144 interweave with the bottom CMD yarns in an "under 3/over 1" sequence that repeats twice within the repeat unit. For example, bottom MD yarn 141 passes below bottom CMD yarns 151-153, above bottom CMD yarn 154, below bottom CMD yarns 155-157, and above bottom CMD yarn 158. The other bottom MD yarns 142-144 follow a similar "under 3/over 1" pattern relative to the bottom CMD yarns. The result is a series of bottom, or machine, side MD floats formed by the bottom MD yarns that pass below three bottom CMD yarns.

Notably, the MD stitching yarns 101-108 each stitch underneath the bottom CMD yarns in a location where they can be protected by two adjacent bottom MD yarn floats. For example, MD stitching yarns 101, 102 stitch below, respectively, bottom CMD yarns 151, 155. Adjacent bottom MD yarns 141, 144 pass below both of these bottom CMD yarns. As such, the bottom MD floats formed by the bottom MD yarns 141, 144 can protect the MD stitching yarns from wear, which can increase the life of the fabric 100.

In addition, it is believed that the presence of the long MD floats (i.e., floats that pass below three or more bottom MD yarns) may reduce drag of the fabric on the paper machine. In many embodiments, the bottom MD yarns comprise monofilament yarns, which tend to have considerable molecular alignment in the axial direction (induced during an extrusion process). In MD yarns, this alignment is substantially parallel with the machine direction. This molecular alignment may reduce drag of the fabric and the power requirement on the paper machine. The MD float and the molecular alignment within the floats may together reduce the wear rate of the fabric on the paper machine.

The materials for an exemplary embodiment of the fabric 100 are described in Table 1, with weaving and performance characteristics of the fabric shown in Table 2.

TABLE 1

| Yarn Type | Material | Size (mm) |
|---|---|---|
| MD Stitching | PET | 0.15-01.8 |
| Bottom MD | PET | 0.32-0.36 |
| Top CMD | PET | 0.16-0.22 |
| Bottom CMD | PET | 0.36-0.48 |

TABLE 2

| | |
|---|---|
| Top Mesh (per in.) | 38 × 76 |
| Permeability (cfm) | 593 |
| Top Open Area (%) | 34.9 |
| Fiber Support Index | 127 |

It can also be seen from Table 1 that, in some embodiments, the MD stitching yarns are of smaller diameter than the bottom MD yarns (a ratio of top MD yarn diameter to bottom MD yarn diameter of between about 0.4 and 0.7 is typical). The use of finer MD stitching yarns can improve the papermaking surface, whereas the use of larger bottom MD yarns can improve wear.

The concept can also be applied to fabrics that have CMD stitching. For example, turning now to FIGS. 4-6C, a repeat unit of another fabric, designated broadly at 200, is illustrated therein. The repeat unit 200 includes ten top MD yarns 201-210, ten top CMD yarns 211-220, ten pairs of CMD stitching yarns 221*a*, 221*b*-230*a*, 230*b*, ten bottom MD yarns 231-240, and ten bottom CMD yarns 241-250. The interweaving of these yarns is described below.

Figure 4:
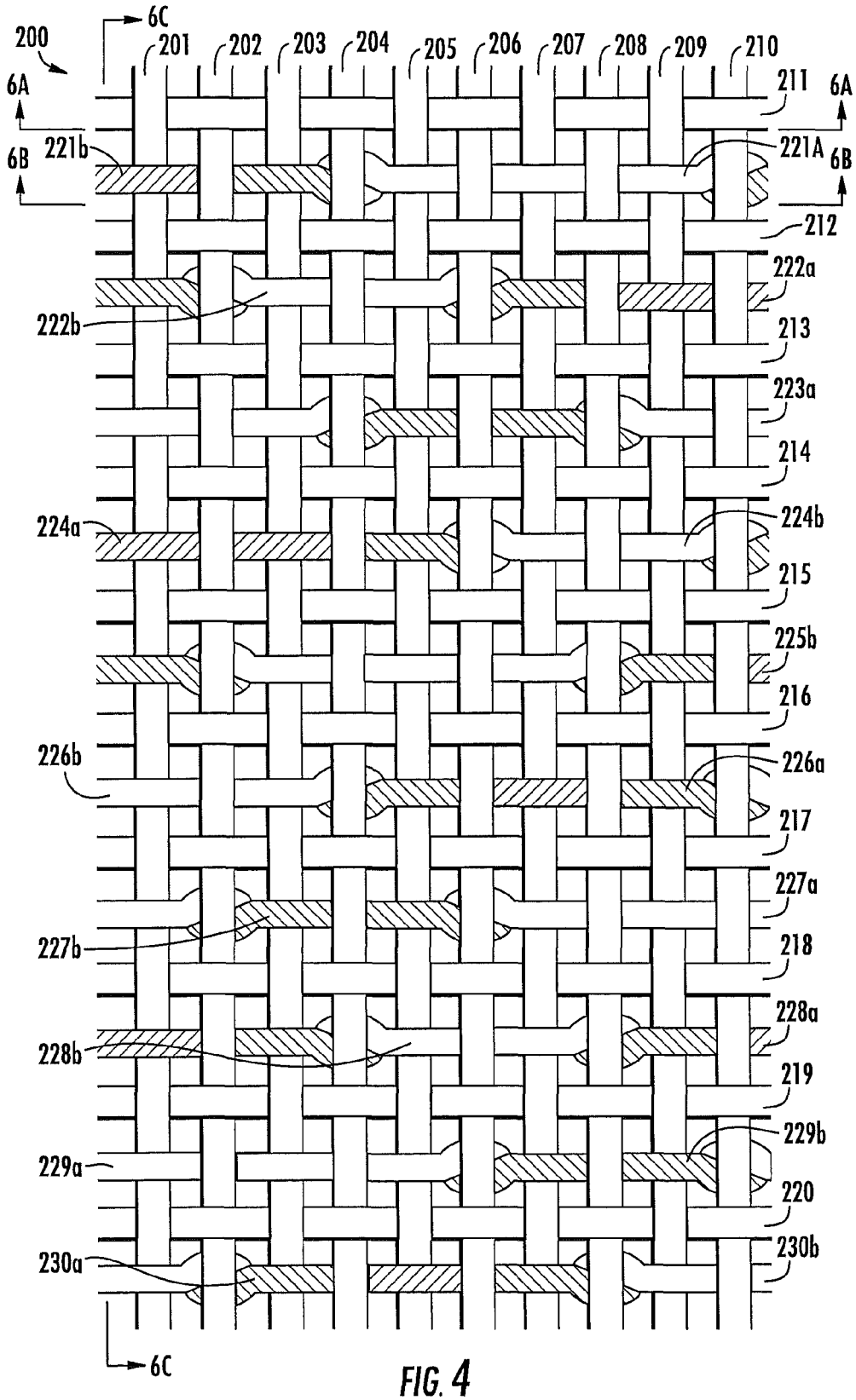
FIG. 4 is a top view of the top layer of a repeat unit of a fabric according to additional embodiments of the present invention.
Figure 6A:
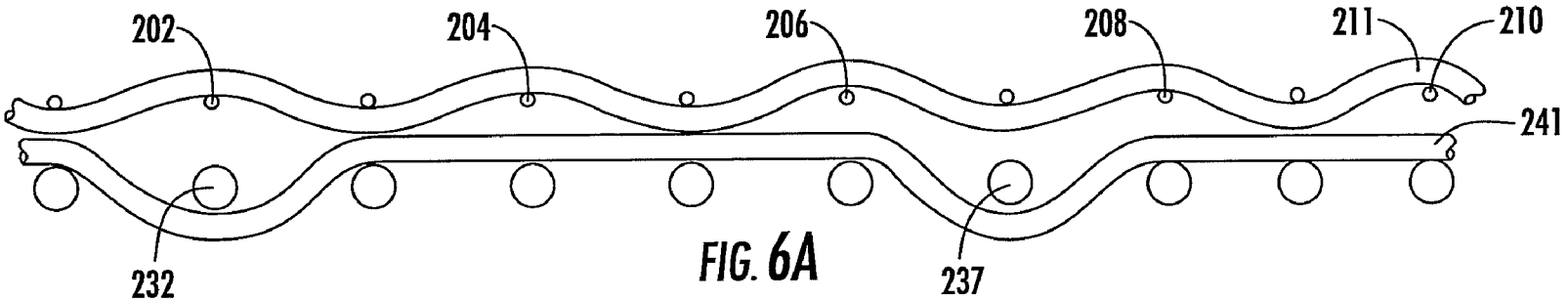
FIGS. 6A and 6B are section views taken along lines 6A-6A and 6B-6B, respectively, of the fabric of FIG. 4 showing typical top and bottom CMD yarns (FIG. 6A) and stitching yarns (FIG. 6B).

As seen in FIG. 4, the top MD yarns 201-210 and the top CMD yarns 211-220 are interwoven such that each top CMD yarn passes over and beneath top MD yarns in an alternating fashion, with each top CMD yarn passing over and under the same top MD yarns. For example, as shown in FIGS. 4 and 6A, top CMD yarn 211 passes under odd-numbered top MD yarns 201-209 and over even-numbered top MD yarns 202-210.

Figure 6B:
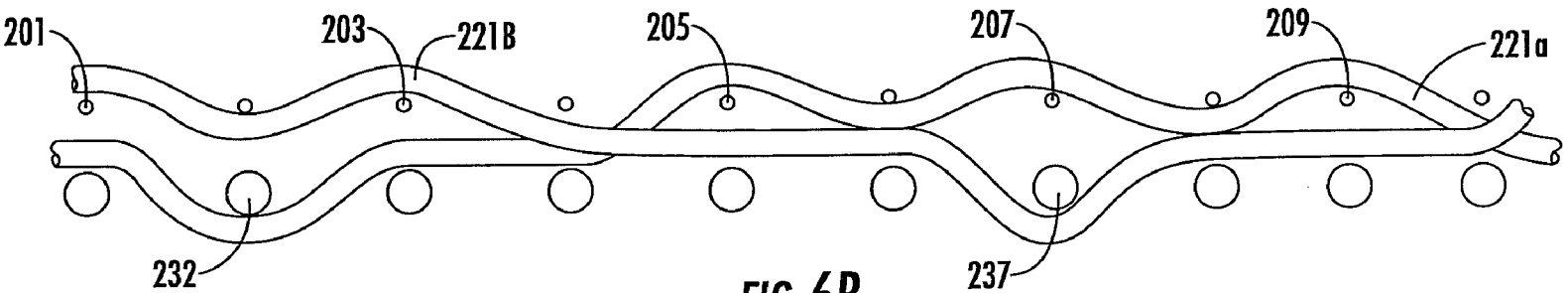

Still referring to FIG. 4 and also to FIG. 6B, the top layer of the fabric 200 also includes portions of the CMD stitching yarns 221*a*-230*b*, which are positioned in pairs between adjacent top and bottom CMD yarns; there is no bottom CMD yarn below each stitching yarn pair so that space is present for the stitching yarns to stitch. Portions of the stitching yarns 221*a*-230*b* interweave with the top MD yarns 201-210 to form, together with the top CMD yarns 211-220, a plain weave pattern in the top surface of the fabric 200. In the illustrated embodiment, a portion of the stitching yarn of each pair designated with an "a" (e.g., 221*a*, 222*a*, etc.) interweaves in an alternating fashion with five top MD yarns (alternately passing over three top MD yarns and under two top MD yarns), and the other stitching yarn of the pair (those designated with a "b") passes over two top MD yarns while passing below a top MD yarn positioned between those two top MD yarns. Thus, together the stitching yarns of a pair pass over each of the odd-numbered top MD yarns 201-209 and pass below each of the even-numbered top MD yarns 202-210 to form an "over 1/under 1" sequence with the top MD yarns. This arrangement can be seen in FIGS. 4 and 6B, which shows stitching yarn 211*a* passing over top CMD yarns 205, 207 and 209 and below top CMD yarns 206 and 208, and further shows stitching yarn 211*b* passing over top MD yarns 201 and 203 while passing under top CMD yarn 202. The other stitching yarns follow a similar pattern, with adjacent stitching yarn pairs being offset from each other by two top MD yarns. The result is the aforementioned plain weave surface.

Figure 5:
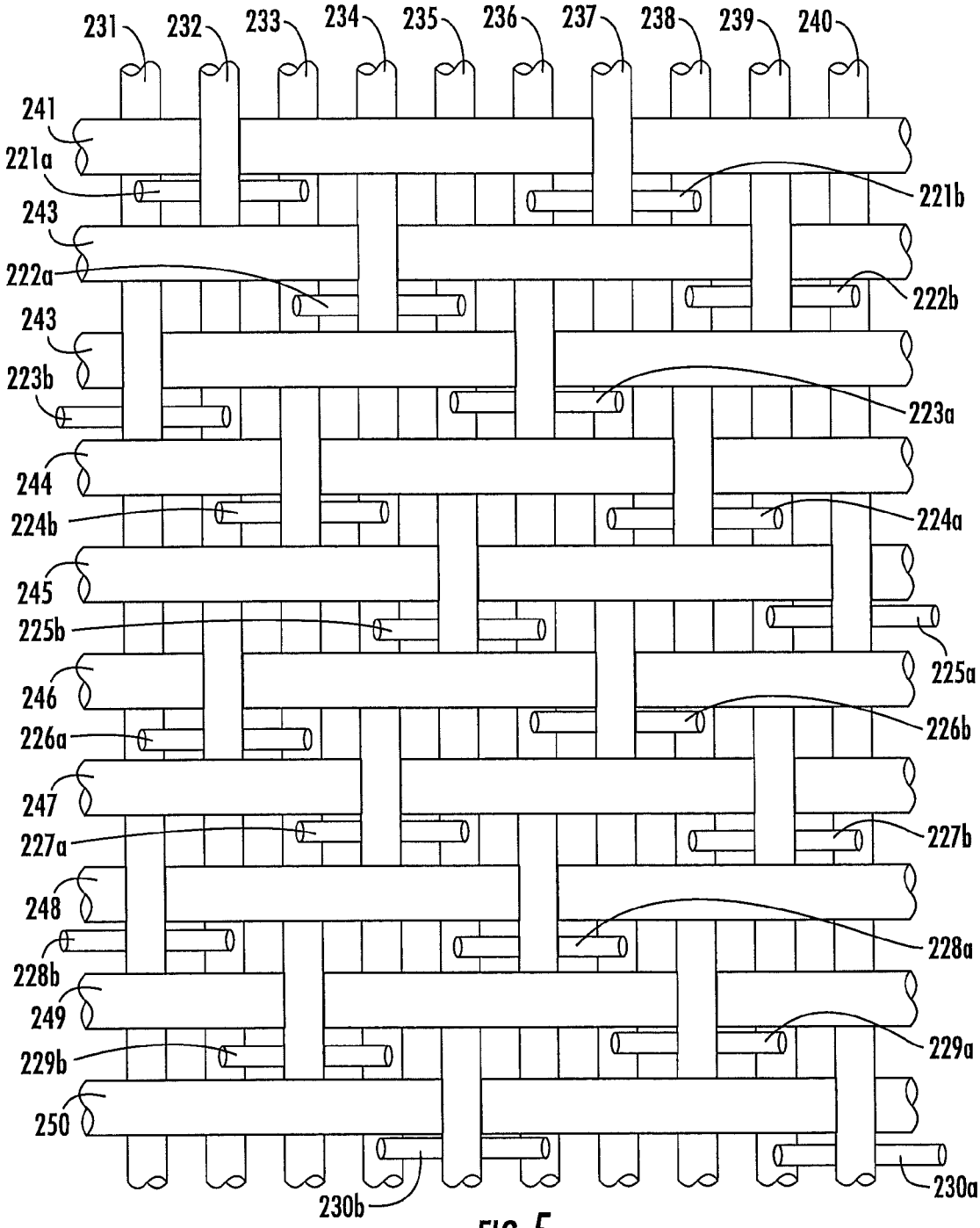
FIG. 5 is a top view of the bottom layer of the fabric of FIG. 4.
Figure 6C:
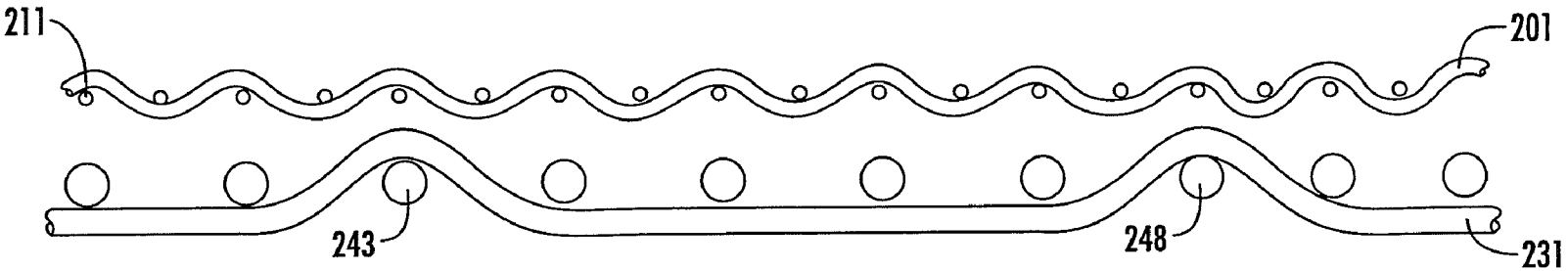
FIG. 6C is a section view taken along lines 6C-6C of FIG. 4 showing typical top and bottom MD yarns.

Referring now to FIGS. 5 and 6C, the bottom layer of the repeat unit of the fabric 200 is illustrated therein. Each of the bottom MD and CMD yarns is positioned substantially directly below a corresponding top MD or CMD yarn. The bottom MD yarns are interwoven with the bottom CMD yarns in an "under 4/over 1" pattern that is repeated twice within the repeat unit.

For example, as shown in FIG. 6C, bottom MD yarn 231 passes below bottom CMD yarns 244-247, above bottom CMD yarn 248, below bottom CMD yarns 249, 250, 241, 242 and above bottom CMD yarn 243. The other bottom MD yarns follow a similar "over 4/under 1/over 4/under 1" weave pattern, but are offset from their adjacent bottom MD yarns by two bottom CMD yarns. The long bottom MD floats formed by the bottom MD yarns can impart reduced drag and, consequently, improved wear resistance in the manner discussed above with respect to the fabric 100 shown in FIGS. 1-3B.

In addition, each of the stitching yarns 221*a*-230*b* passes below one of the bottom MD yarns to form a bottom knuckle, with the bottom knuckles of the stitching yarns of a pair being separated by five bottom MD yarns. For example, and as shown in FIG. 6B, stitching yarn 221*a* passes below bottom MD yarn 232, and stitching yarn 221*b* passes below bottom MD yarn 237. As is the case with the portions of the stitching yarns that interweave with the top MD yarns, the portions of the stitching yarns that interweave with the bottom MD yarns are also separated from each other by two bottom MD yarns.

Notably, the stitching points of the stitching yarns are located immediately adjacent the bottom knuckles formed by the bottom CMD yarns as they pass below a bottom MD yarn. For example, as best seen in FIGS. 5, 6A and 6B, both stitching yarn 211*a* and immediately adjacent bottom CMD yarn 241 pass below bottom MD yarn 232, and both stitching yarn 221*b* and bottom CMD yarn 241 pass below bottom MD yarn 237. As such, the stitching yarns are protected from wear by the presence of the bottom CMD knuckle formed by the adjacent bottom CMD yarn.

It can also be seen in FIGS. 4 and 5 that the stitching yarns are interwoven with the top and bottom MD yarns as "reversed picks." This concept is described in detail in U.S. Pat. No. 5,967,195 to Ward and need not be discussed further herein. Those skilled in this art will appreciate that, although the illustrated reversed picks configuration is preferred, the present invention may also be employed with non-reversed picks fabrics.

As another example of a CMD-stitched fabric, a repeat unit of another fabric, designated broadly at 300, is illustrated in FIGS. 7-9C. The repeat unit 300 includes four top MD yarns 301-304, four top CMD yarns 311-314, four pairs of CMD stitching yarns 321, 321*b*-324*a*, 324*b*, and four bottom MD yarns 331-334. The interweaving of these yarns is discussed in greater detail below.

Figure 7:
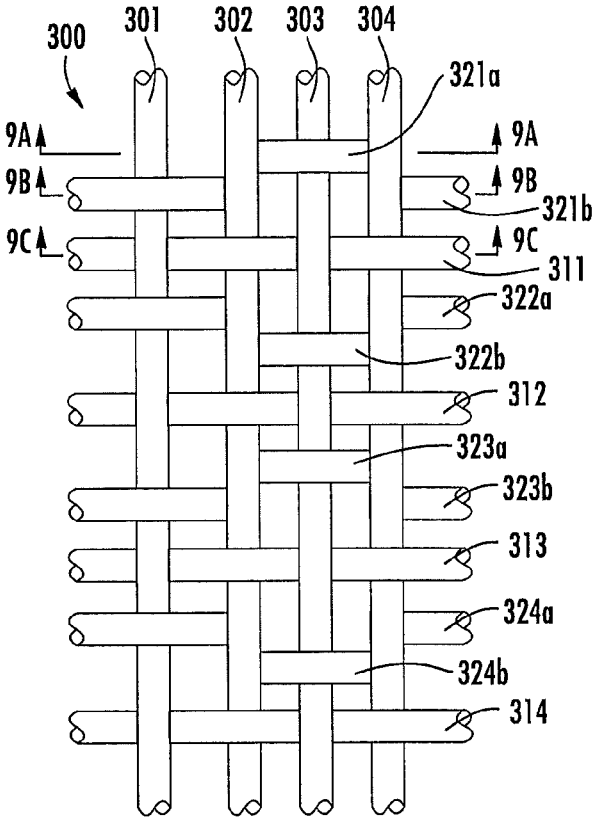
FIG. 7 is a top view of the top layer of a repeat unit of a fabric according to embodiments of the present invention.
Figure 9A:
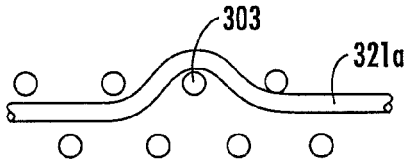
FIGS. 9A-9C are section views taken along lines 9A-9A, 9B-9B and 9C-9C, respectively, of the fabric of FIG. 7 showing typical stitching yarns and CMD yarns.
Figure 9B:
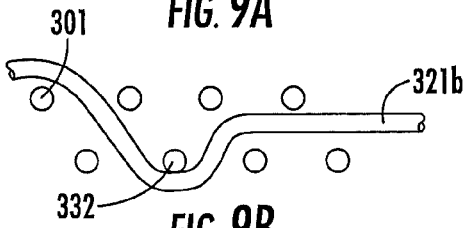
Figure 9C:
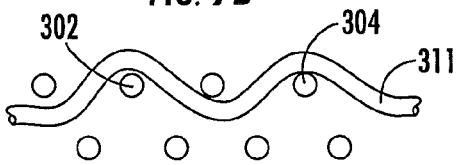

Looking first at FIGS. 7 and 9C, the top MD yarns and top CMD yarns interweave such that the top CMD yarns 311-314 pass under each of the odd-numbered top MD yarns 301, 303 and over each of the even-numbered top MD yarns 302, 304. For example, as shown in FIGS. 7 and 9C, top CMD yarn 311 passes under odd-numbered top MD yarns 301, 303 and over even-numbered top MD yarns 302, 304 to form an "over 1/under 1" pattern. The remaining top CMD yarns follow a similar pattern with respect to the top MD yarns.

Turning now to FIGS. 7, 9A and 9B, the stitching yarn pairs 321*a*, 321*b*-324*a*, 324*b* interweave with the top MD yarns such that one of the stitching yarns (the yarns with an "a" designation) passes over one of the odd-numbered top MD yarns and under the other top MD yarns. For example, as shown in FIG. 9A, the stitching yarn 321*a* passes over the top MD yarn 303 and under the other top MD yarns. The stitching yarn of a pair with a "b" designation passes over the odd-numbered stitching yarn in the repeat unit that the "a" yarn does not; for example, the stitching yarn 321*b* passes over top MD yarn 301 and under the remaining top MD yarns (FIG. 9B). Thus, together the stitching yarns 321*a*, 321*b* follow an "over 1/under 1" sequence with respect to the top MD yarns. As such, the top MD yarns, the top CMD yarns, and the stitching yarns combine to form a plain weave papermaking surface.

Figure 8:
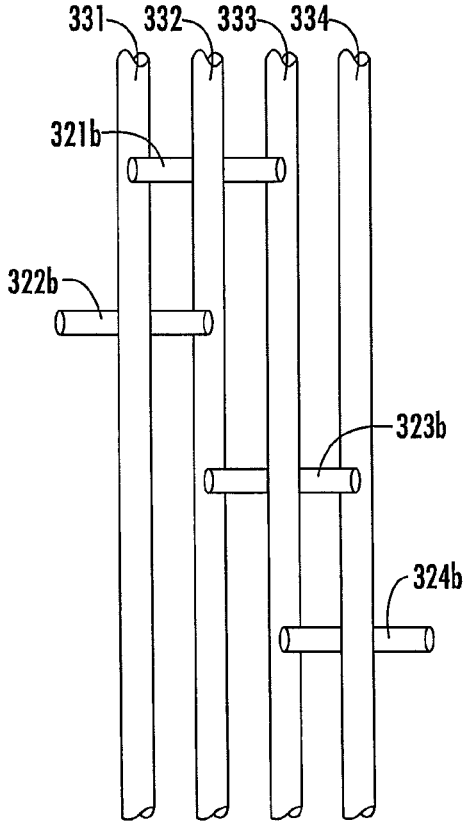
FIG. 8 is a top view of the bottom layer of the fabric of FIG. 7.

Referring now to FIGS. 8, 9A and 9B, each of the "b" stitching yarns passes below one of the bottom MD yarns 331-334; however, the "a" stitching yarns do not (i.e., they are so-called "phantom" stitching yarns). For example, stitching yarn 321*a* does not pass below any of the bottom MD yarns, but stitching yarn 321*b* passes below bottom MD yarn 332 (see FIGS. 9A and 9B). The remaining stitching yarn pairs follow a similar pattern. The result is that each of the bottom MD yarns 331-334 forms an "under 3/over 1" pattern with the "b" stitching yarns, with the result that the bottom MD yarns form long MD floats (in this case, floats that are three CMD yarns in length) on the bottom surface of the fabric (see FIG. 8).

It should also be noted in FIGS. 9A-9C that the bottom MD yarns are staggered relative to the top MD yarns; in other words, the bottom MD yarns are not positioned directly beneath the top MD yarns, but are positioned directly below the space between adjacent top MD yarns.

Another example of a fabric that is MD-stitched is shown in FIGS. 10-12C, wherein a repeat unit of another forming fabric according to embodiments of the present invention, designated broadly at 400, is illustrated. The repeat unit 400 includes four top MD yarns 401-404, eight MD stitching MD yarns 411*a*, 411*b*-414*a*, 414*b*, thirty top CMD yarns 421-450, and twelve bottom MD yarns 451-462, and twelve bottom CMD yarns 471-482. The interweaving of these yarns is described below.

Figure 10:
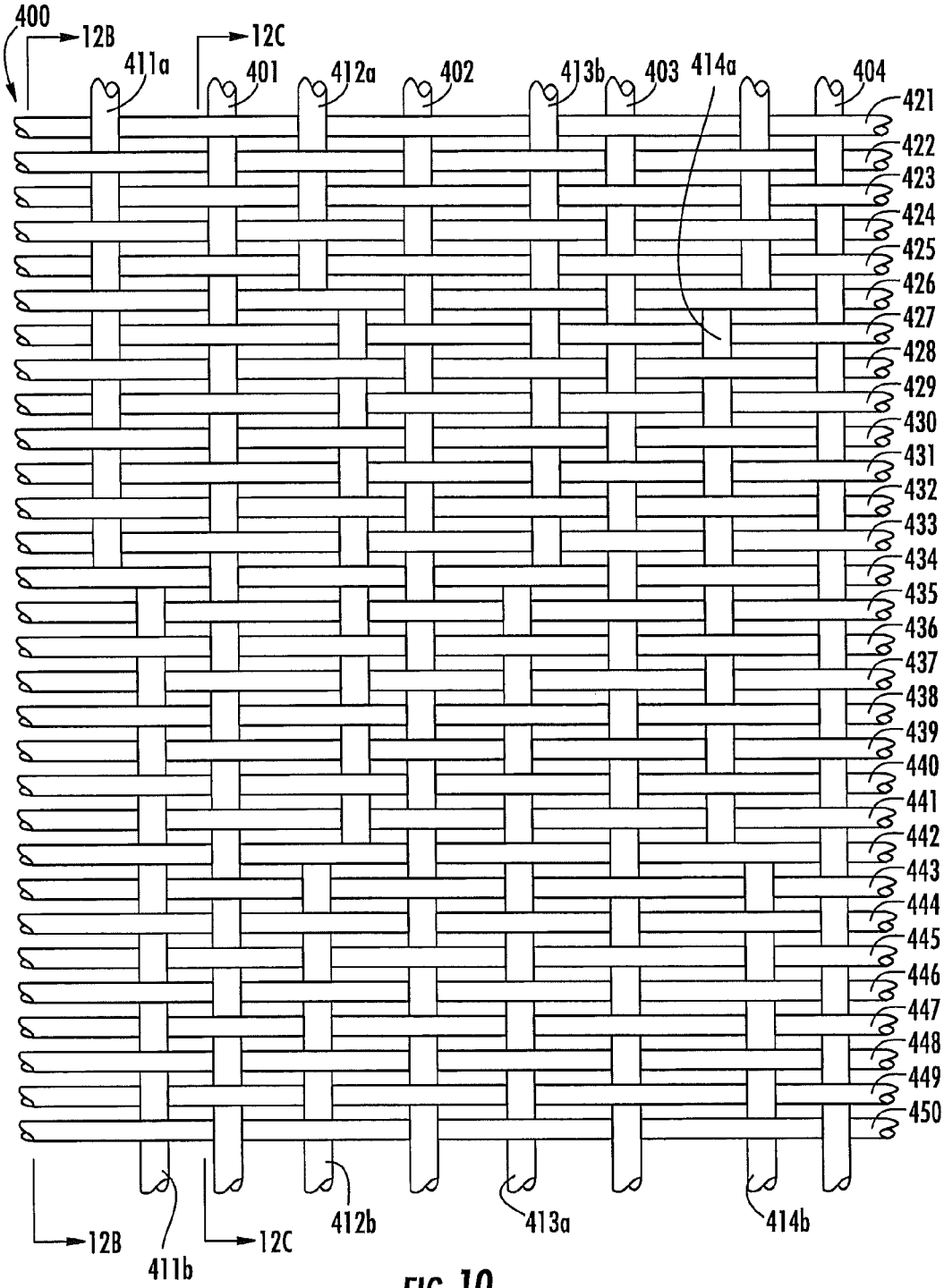
FIG. 10 is a top view of the top layer of a repeat unit of a fabric according to additional embodiments of the present invention.
Figure 12A:
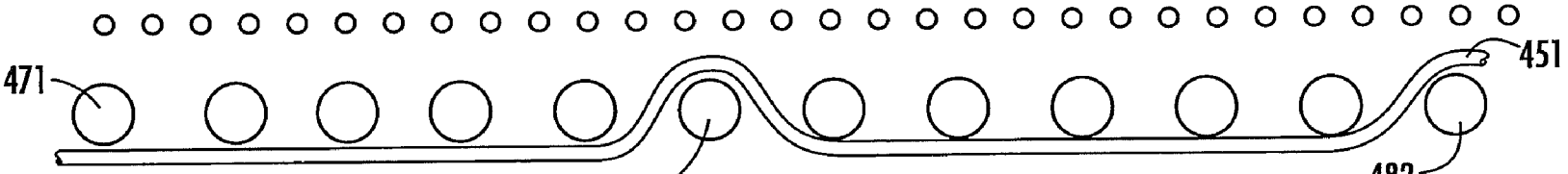
FIGS. 12A-12C are section views taken along lines 12A-12A, 12B-12B and 12C-12C, respectively, of the fabric of FIGS. 10 and 11 showing typical bottom MD yarns (FIG. 12A), stitching yarns (FIG. 12B) and top MD yarns (FIG. 12C).
Figure 12B:
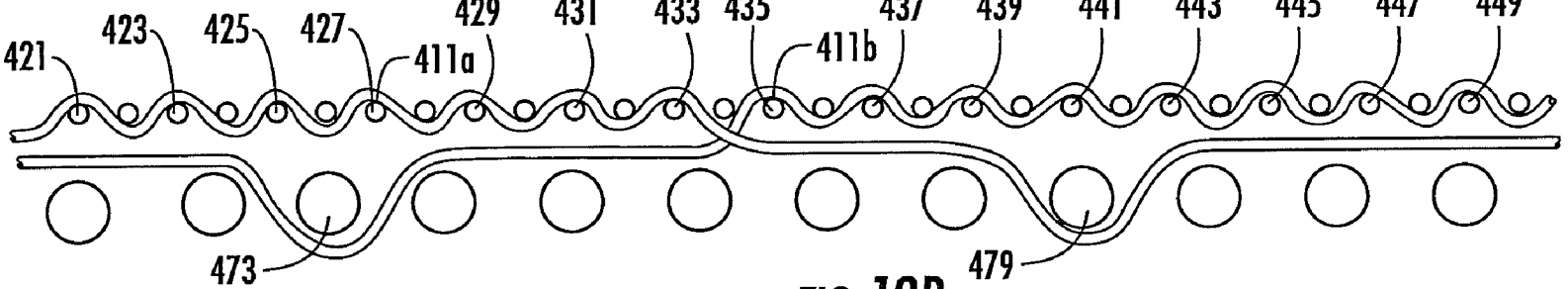
Figure 12C:
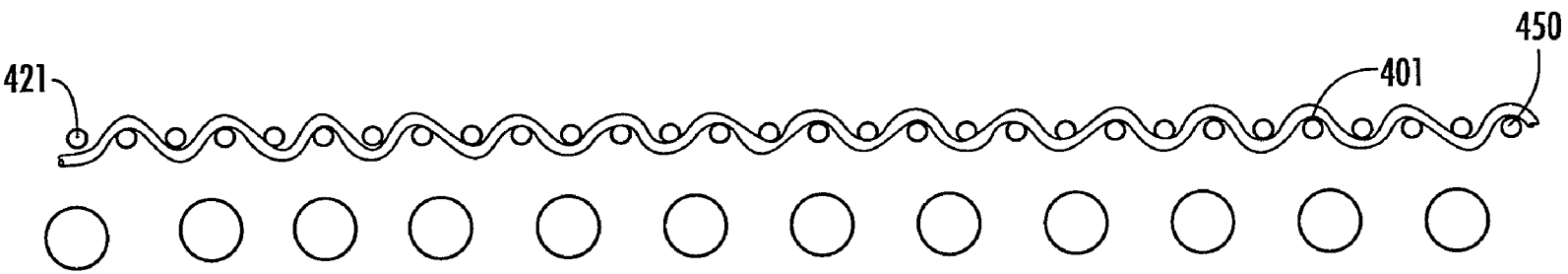

As can be seen in FIGS. 10 and 12C, each of the top MD yarns 401-404 interweaves with the top CMD yarns 421-450 in an "over 1/under 1" sequence, in which the top MD yarns 401-404 pass under the odd-numbered top CMD yarns 421-449 and over the even-numbered top CMD yarns 422-450. As an example, and as shown in FIG. 12C, top MD yarn 401 passes over even-numbered top CMD yarns 422-450 and under odd-numbered top CMD yarns 421-449. This pattern is repeated for the remainder of the top MD yarns 402-404.

Referring now to FIGS. 10 and 12B, the MD stitching yarns 411*a*, 411*b*-414*a*, 414*b* are disposed in pairs, wherein each pair together interweaves with the top CMD yarns 421-450 in an "over 1/under 1" sequence. For example, as can be seen in FIGS. 10 and 12B, MD stitching yarn 411*a* follows an "over 1/under 1" pattern relative to the top CMD yarns to form seven consecutive MD knuckles (passing over odd-numbered top CMD yarns 421-433 and below even-numbered top CMD yarns 422-432). MD stitching yarn 411*a* passes below the remaining top CMD yarns 434-450. Paired stitching yarn 411*b* follows an "over 1/under 1" pattern relative to the top CMD yarns to form eight consecutive MD knuckles (passing over odd-numbered top CMD yarns 435-449) and below even-numbered top CMD yarns 436-448). MD stitching yarn 411*b* passes below the remaining top CMD yarns. Thus, together the MD stitching yarns 411*a*, 411*b* follow an "over 1/under 1" pattern relative to the top CMD yarns. The remaining MD stitching yarn pairs (i.e., MD stitching yarns 412*a*, 412*b*, MD stitching yarns 413*a*, 413*b*, and MD stitching yarns 414*a*, 414*b*) follow a similar "over 1/under 1" sequence with the top CMD yarns. As a result, the top MD yarns, top CMD yarns, and stitching yarns combine to form a plain weave surface.

Figure 11:
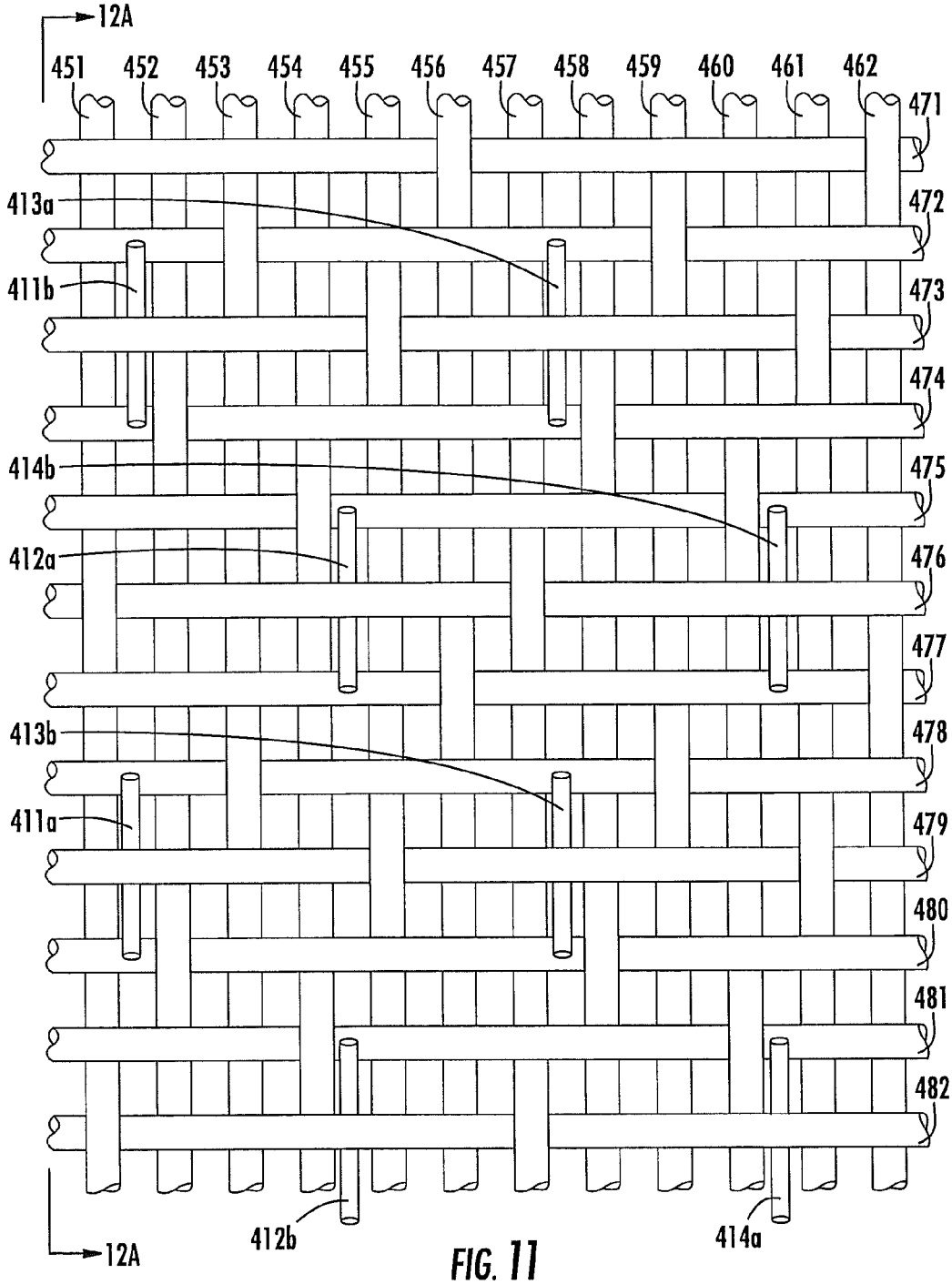
FIG. 11 is a top view of the bottom layer of the fabric of FIG. 10.

Turning now to FIG. 11 and also to FIG. 12, the MD stitching yarns 411*a*-414*b* also interweave with the bottom CMD yarns 471-482. Each of the MD stitching yarns 411*a*-414*b* passes below one bottom CMD yarn, with the MD stitching yarns of each pair together forming "over 5/under 1" pattern. For example, and referring to FIG. 12B, MD stitching yarn 411*a* passes under bottom CMD yarn 479 and over the remaining bottom CMD yarns. MD stitching yarn 411*b* passes under bottom CMD yarn 473, thus combining with MD stitching yarn 411*a* to form the "over 5/under 1" sequence with the bottom CMD yarns noted above. The remaining MD stitching yarn pairs similarly form an "over 5/under 1" sequence with the bottom CMD yarns.

Referring again to FIG. 11 and also to FIG. 12A, the bottom MD yarns 451-462 interweave with the bottom CMD yarns in an "under 5/over 1" sequence that repeats twice within the repeat unit. For example, bottom MD yarn 451 passes below bottom CMD yarns 471-475, above bottom CMD yarn 476, below bottom CMD yarns 477-481, and above bottom CMD yarn 482. The other bottom MD yarns 452-462 follow a similar "under 5/over 1" pattern relative to the bottom CMD yarns. Thus, the bottom MD yarns form long MD floats (in this instance under five bottom CMD yarns) that may have the same drag reduction and wear resistance discussed above.

Also, each of the stitching locations is positioned under a bottom CMD yarn that the adjacent bottom MD yarns do not pass under. As such, the stitching locations can be protected as described above.

The form of the yarns utilized in fabrics of the present invention can vary, depending upon the desired properties of the final papermaker's fabric. For example, the yarns may be monofilament yarns, flattened monofilament yarns as described above, multifilament yarns, twisted multifilament or monofilament yarns, spun yarns, or any combination thereof. Also, the materials comprising yarns employed in the fabric of the present invention may be those commonly used in papermaker's fabric. For example, the yarns may be formed of polyester, polyamide (nylon), polypropylene, aramid, or the like. The skilled artisan should select a yarn material according to the particular application of the final fabric. In particular, round monofilament yarns formed of polyester or polyamide may be suitable, and, as noted, the use of monofilament yarns as bottom MD yarns may be particularly suitable.

Those skilled in this art will appreciate that yarns of different sizes may be employed in fabric embodiments of the present invention. As noted above, in embodiments that include both top and bottom MD yarns, the top MD yarns may be of a smaller diameter than the bottom MD yarns. For example, the top MD yarns, top CMD yarns, and stitching yarns may have a diameter of between about 0.10 and 0.20 mm, the bottom MD yarns may have a diameter of between about 0.15 and 0.25 mm, and the bottom CMD yarns may have a diameter of between about 0.20 and 0.30 mm. The mesh of fabrics according to embodiments of the present invention may also vary. For example, the mesh of the top surface may vary between about 20×30 to 30×50 (epcm to ppcm), and the total mesh may vary between about 60×45 to 90×75.

In addition, the numbers of different types of yarns relative to other types of yarns may vary. For example, in some of the embodiments shown, the ratio of top MD yarns to bottom MD yarns is 1:1; in others, the ratio of "effective" top MD yarns (i.e., the number of top MD yarns plus the number of MD stitching yarn pairs) to bottom MD yarns is 1:1 or 2:3, but other ratios may also be employed. In some embodiments, the number of top CMD yarns to bottom CMD yarns is 1:1; in others, the number of "effective" top CMD yarns (i.e., the number of top CMD yarns plus the number of CMD stitching yarn pairs) is 2:1; and in other embodiments, the ratio of top CMD yarns to bottom CMD yarns is 5:2; however, other ratios may also be employed.

Finally, although each of the embodiments include a plain weave top surface, other embodiments may include a top surface having a different weave pattern, including twill, satin, or the like. In addition, the long MD float bottom surfaces of the fabrics may take other weave patterns, including satin, twill or the like.

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paper stock is well understood by those of skill in the art, additional details regarding this aspect of the present invention need not be provided herein.

The foregoing embodiments are illustrative of the present invention, and are not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A papermaker's fabric, comprising:

a set of top machine direction (MD) yarns;

a set of bottom MD yarns;

a set of top cross machine direction (CMD) yarns interwoven with the top MD yarns to form a top fabric layer;

a set of bottom CMD yarns interwoven with the bottom MD yarns to form a bottom fabric layer;

and a set of stitching yarns arranged in pairs, wherein at least one of the stitching yarns of the pair interweaves with the top and bottom fabric layers;

wherein the top MD yarns and the top CMD yarns are interwoven in a series of repeat units and the bottom MD yarns and the bottom CMD yarns are interwoven in a series of corresponding repeat units;

wherein the ratio of effective top CMD yarns to bottom CMD yarns is 5:2.

2. The papermaker's fabric defined in claim 1, wherein each of the bottom MD yarns forms a bottom MD float by passing under three or more consecutive bottom CMD yarns.

3. The papermaker's fabric defined in claim 2, wherein the bottom MD floats pass under between three and five consecutive bottom CMD yarns.

4. The papermaker's fabric defined in claim 1, wherein the bottom MD yarns comprise monofilament yarns.

5. The papermaker's fabric defined in claim 1, wherein the stitching yarn pairs comprise MD stitching yarns.

6. The papermaker's fabric defined in claim 1, wherein the stitching yarn pairs comprise CMD stitching yarns.

7. The papermaker's fabric defined in claim 1, wherein the top MD yarns, the top CMD yarns, and the stitching yarns combine in the top fabric layer to form a plain weave top surface.

8. The papermaker's fabric defined in claim 1, wherein one of the stitching yarns of each pair is a phantom stitching yarn.

9. The papermaker's fabric defined in claim 2, wherein each of the stitching yarns stitches below a bottom CMD yarn that is one of the consecutive yarns that each of the adjacent bottom MD yarn passes under in forming the bottom MD float.

10. The papermaker's fabric defined in claim 6, wherein each of the stitching yarns stitches under a bottom MD yarn that an adjacent bottom CMD yarn also passes under.

11. The papermaker's fabric defined in claim 1, wherein the top MD yarns have a first diameter, the bottom MD yarns have a second diameter, and the first diameter is smaller than the second diameter.

12. A papermaker's fabric, comprising:

a set of bottom machine direction (MD) yarns;

a set of top cross machine direction (CMD) yarns;

a set of bottom CMD yarns interwoven with the bottom MD yarns to form a bottom fabric layer; and a set of MD stitching yarns arranged in pairs, wherein at least one of the stitching yarns of the pair interweaves with the top and bottom fabric layers, and wherein the MD stitching yarns interweave with the top CMD yarns to form a top fabric layer;

wherein the top MD yarns and the top CMD yarns are interwoven in a series of repeat units and the bottom MD yarns and the bottom CMD yarns are interwoven in a series of corresponding repeat units; and wherein the ratio of effective top CMD yarns to bottom CMD yarns is 5:2.

* * * * *

UNITED STATES PATENT AND TRADEMARK OFFICE

CERTIFICATE OF CORRECTION

PATENT NO. : 7,931,051 B2
APPLICATION NO. : 12/708684
DATED : April 26, 2011
INVENTOR(S) : Ward et al.

It is certified that error appears in the above-identified patent and that said Letters Patent is hereby corrected as shown below:

On Title Page:

Item (56) References Cited, Foreign Patent Documents, Page 2, Right column, line 15:

Please correct "EP 0 672 752 B1" to read -- EP 0 672 782 B1 --

Signed and Sealed this
Twentieth Day of September, 2011

David J. Kappos

David J. Kappos
*Director of the United States Patent and Trademark Office*